United States Patent [19]

Budris

[11] 4,116,583

[45] Sep. 26, 1978

[54] MULTI-PURPOSE END CASINGS FOR RING TYPE MULTI-STAGE CENTRIFUGAL PUMPS

[75] Inventor: Allan R. Budris, Nutley, N.J.

[73] Assignee: Worthington Pump, Inc., Mountainside, N.J.

[21] Appl. No.: 773,709

[22] Filed: Mar. 2, 1977

[51] Int. Cl.[2] ..... F01D 25/24; F03B 11/02

[52] U.S. Cl. ..... 415/199.1; 415/199.2; 415/219 R; 415/219 C; 417/360

[58] Field of Search ..... 415/198.1, 199.1, 199.2, 415/DIG. 3, 219 R, 219 C, 111, 169 R, 121 R; 417/360, 424, 238

[56] References Cited

U.S. PATENT DOCUMENTS

| | | | |
|---|---|---|---|
| 1,130,422 | 3/1915 | Mueller | 415/199.2 |
| 2,339,186 | 1/1944 | Noble | 415/111 |
| 2,365,310 | 12/1944 | Thomann et al. | 415/199.1 X |
| 3,249,057 | 5/1966 | Callahan | 417/360 UX |

FOREIGN PATENT DOCUMENTS

| | | | |
|---|---|---|---|
| 1,050,253 | 9/1953 | France | 415/199.1 |
| 571,999 | 3/1933 | Fed. Rep. of Germany | 415/199.1 |
| 1,439,386 | 9/1953 | United Kingdom | 415/111 |
| 622,669 | 5/1949 | United Kingdom | 415/199.2 |

*Primary Examiner*—Carlton R. Croyle
*Assistant Examiner*—Donald S. Holland
*Attorney, Agent, or Firm*—Daniel H. Bobis

[57] ABSTRACT

Multi-purpose end casing for ring type multi-stage centrifugal pumps adaptable respectively for the side suction end casings and side discharge end casings of horizontal, vertical and dry pit side suction multi-stage ring type centrifugal pumps, are disclosed as having a generally cylindrical body portion having at least four tie rod lugs extending therefrom at generally 90° intervals. Each of the tie rod lugs has an ample adapter bearing surface, and a rabbet fitted surface formed thereon to render the same utilizable with a variety of adapters as may be required in different types of pumps on which the end casings are used. Machined, foot mounting surfaces are provided on at least three sides of the respective side suction end casings and side discharge end casings to enable the ready attachment and detachment of pump casing mounting feet. In addition, bearing housings including provision for pump stuffing box leakage collection and drainage are operatively associated with the respective end casings to provide additional versatility.

9 Claims, 13 Drawing Figures

MULTI-PURPOSE END CASINGS FOR RING TYPE MULTI-STAGE CENTRIFUGAL PUMPS

BACKGROUND OF THE INVENTION

This invention relates to multi-purpose end casings which are particularly, though not exclusively, adapted for use in multi-stage, ring type centrifugal pumps.

Although end casings for multi-stage, ring type centrifugal pumps fabricated for use with intermediate stage casing and components, are well known in the prior art, such end casings generally have been specifically designed for use with one, only, of the variety of configurations in which these centrifugal pumps are marketed. More specifically, special end casings have, heretofore been required respectively for horizontal side suction multi-stage ring type centrifugal pumps; and for vertical dry pit side suction multi-stage ring type centrifugal pumps.

It will be clear to those skilled in this art that these requirements for different and specialized end casings for each of a variety of pump configurations results in an increase in end casing inventories and cost for manufacture of each of these variety of pump configurations.

The present invention seeks to overcome this problem by providing multi-purpose suction end casings and multi-purpose discharge end casings adapted for use with multi-stage ring type centrifugal pumps taking any one of a variety of possible pump configurations.

The use of such multi-purpose end casings is achieved by the relatively simple means of providing two types of alternate attaching means; one being spaced machined foot mounting surfaces on one or more sides of each of the respective multi-purpose end casings which can be aligned to permit pump mounting feet to be detachably connected thereto; the other being enlarged machined bearing surfaces on the outer faces of the tie rod lugs of the respective suction end casings and discharge end casings which define a rabbet joint thereon and against which adapters can be connected; to permit the associated pump to be oriented horizontally or vertically as will be more fully described hereinafter.

Further bearing housings may be operatively associated with the respective multi-purpose end casings to collect stuffing box leakage in either the horizontal or vertical installation aspect of a given type of multi-stage ring type centrifugal pump.

SUMMARY OF THE INVENTION

Thus, the present invention covers a multi-stage ring type centrifugal pump for horizontal and vertical orientation, said centrifugal pump having a plurality of serially connected intermediate pumping stages forming a fluid pumping flow path therethrough having an inlet, and an outlet, a multi-purpose suction end casing forming a suction inlet disposed to deliver fluid to be pumped to the inlet end of said fluid pumping flow path, a multi-purpose discharge end casing forms the volute or collector for a discharge pumping stage having an impeller in communication with the outlet of the fluid pumping flow path to receive pumped fluid therefrom, said multi-purpose discharge end casing having a discharge outlet for the pumped fluid, a first set of spaced tie rod lugs on said suction end casing, a second set of spaced tie rod lugs on said discharge end casing, said suction end casing and discharge end casing movable to permit said first set and said second set of tie rod lugs to be aligned to each other, tie rod means for connecting said first set and said second set of aligned tie rod lugs to assemble said suction end casing, said plurality of intermediate pumping stages, and said discharge end casing into the multi-stage ring type centrifugal pump, a first set of spaced foot mounting means on said suction end casing, a second set of foot mounting means on said discharge end casing, said suction end casing and discharge end casing movable to align the respective first set of foot mounting means and second set of foot mounting means relative each other simultaneously with the alignment of said tie rod lugs, an enlarged bearing and connecting surfaces for the outer face of said first set and said second set of tie rod lugs to permit adapters for various supports and uses to be alternatively and operatively connected to the respective suction end casing and discharge end casing for the given centrifugal pump.

Additionally the multi-stage ring type centrifugal pump as above described having detachable foot means alternatively and operatively connectable to said first set and said second set of aligned mounting means for providing horizontal orientation of the given centrifugal pump.

Additionally the multi-stage ring type centrifugal pump as respectively above described having, adapter means alternatively and operatively connectable to the bearing and connecting surfaces on the tie rod lugs for providing vertical orientation of the centrifugal pump, and said tie rod lugs elongated to affix the adapter means in assembled position.

Additionally a generally cylindrical multi-purpose suction end casing for a multi-stage ring type centrifugal pump having a plurality of angularly spaced tie rod lugs thereon, said plurality of spaced tie rod lugs having an enlarged bearing surface on the outer face thereof to form a rabbet joint, and a plurality of angularly spaced foot mounting means.

Additionally a generally cylindrical multi-purpose discharge end casing for a multi-stage ring type centrifugal pump having a plurality of angularly spaced tie rod lugs thereon, said tie rod lugs having an enlarged bearing surface on the outer face thereof to form a rabbet joint, and a plurality of angularly spaced foot mounting means.

OBJECTS OF THE INVENTION

It is accordingly, an object of this invention to provide new and improved, multi-purpose end casings which are suitable for use with multi-stage, ring type centrifugal pumps taking any one of a variety of pump configurations.

Another object of this invention is the provision of multi-purpose end casings as above which are particularly adapted for operative association with pump bearing housings having appropriate provision for stuffing box leakage fluid collection and drainage in both horizontally and vertically oriented centrifugal pumps.

A further object of this invention is the provision of universal end casings as above described which are of generally straight-forward design and which can be manufactured for substantially the same cost as the specialized end casings of the prior art.

DESCRIPTION OF THE DRAWINGS

The above and other objects and advantages of the invention will be made clear by the following detailed description thereof taken in conjunction with the accompanying drawings in which:

Referring to the drawings FIG. 1 shows a horizontally disposed multi-stage ring type centrifugal pump generally designated 10 having multi-purpose end casings in accordance with the present invention. The multi-purpose suction end casing being designated 31 and the multi-purpose discharge end casing being designated 61. Centrifugal pump 10 includes a plurality of adjacent and serially disposed ring like intermediate pump stage casing members as at 11, 12, 13, 14, 15 and 16 which are connected between the multi-purpose suction end casing 31 and multi-purpose discharge end casing 61 by means of circumferentially spaced tie rods 17 held in assembled position by tie rod securing means or locking nuts 18 and 19 at the respective opposite ends of each of said tie rods so that the assembled multi-purpose end casings with the plurality of intermediate stage pump casing members provides and forms the pump casing as will be understood by those skilled in the art.

Figure 1:
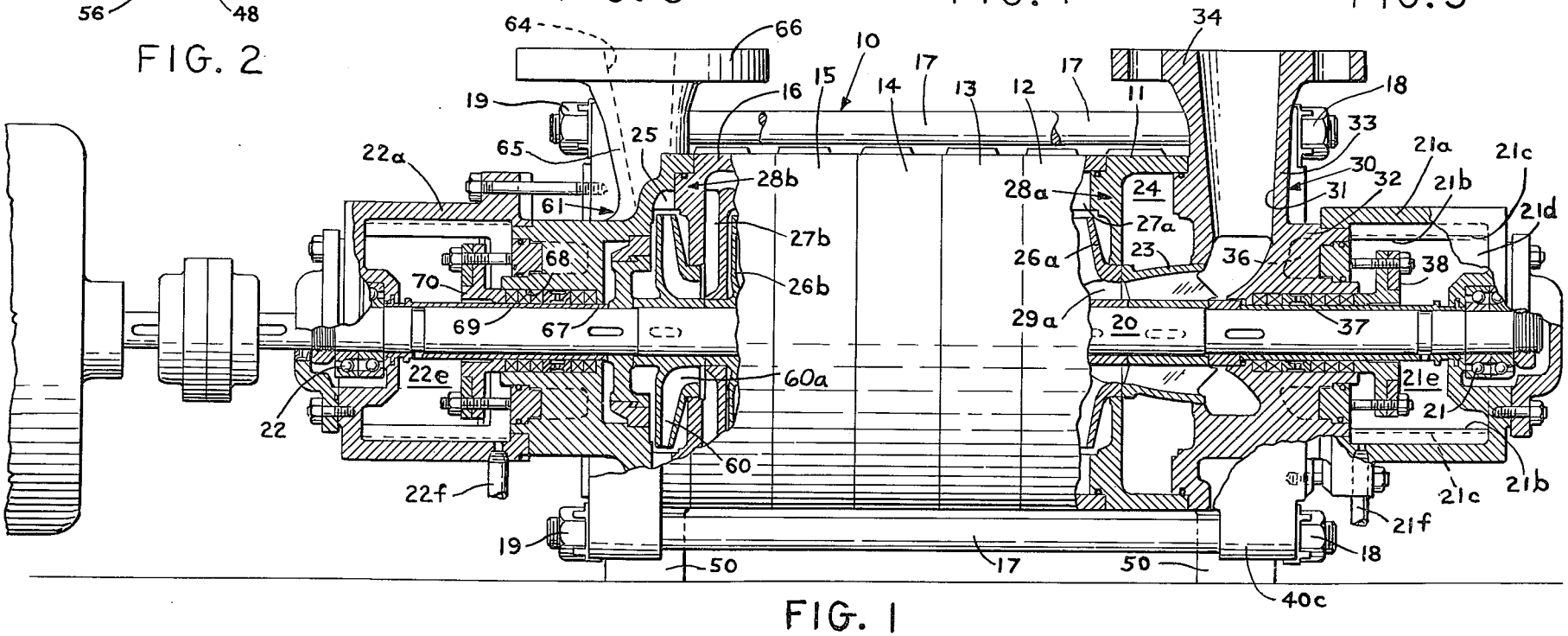
FIG. 1 is a side elevational view, with parts in cross-section, of a multi-stage ring type centrifugal pump having multi-purpose end casings thereon in accordance with the present invention and showing the detachably connected feet orienting the centrifugal pump for horizontal disposal.

A pump shaft 20 extends end to end through the centrifugal pump 10 and is journalled for rotation in bearings 21 and 22 as is shown in FIG. 1 of the drawings.

By further reference to FIG. 1 it will be noted that the normal position occupied by the first intermediate pumping stage only includes the pump casing member 11 and that in place of the impeller and volute for said first pumping stage a generally convergent inducer 23 is positioned and connected for rotation with the shaft 20 as is clearly shown in FIG. 1 of the drawings.

Inducer 23 and its operative relation to a multi-purpose ring type centrifugal pump is more fully illustrated and described in my co-pending application Ser. No. 742,899 filed Nov. 18, 1976.

The ring like pumping stage casing members 11, 12, 13, 14, 15 and 16 house a plurality of intermediate pumping stages with only the initial pumping stage generally designated 24 and the last pumping stage generally designated 25 being substantially fully illustrated in FIG. 1. Each of the intermediate pumping stages respectively include, impellers as at **26*a* and 26*b*, ring like interstage pumping casings as at 12 and 16, and discharge diffusers 27*a* and 27*b* as partially illustrated for second pumping stage 28*a* and next the last pumping stage 28*b***.

The respective impellers **26*a* and 26*b* are attached to the pump shaft 20** for driven rotation therewith.

The inducer 23 is operatively mounted in the space normally occupied by the conventional first pumping stage 24 of the plurality of intermediate pumping stages. The second pumping stage **28*a* is the initial conventional pumping stage. However, because it receives fluid to be pumped from the inducer 23** it will be referred to as the second pumping stage.

The inducer 23 may take the form as disclosed and claimed in my co-pending application for U.S. Letters Patent identified under Ser. No. 742,899 filed Nov. 18, 1976 and it will be understood by those skilled in the art that a first centrifugal pumping stage may of course be conventionally used in the space occupied by the said inducer 23.

The inducer 23 is disposed so as to discharge fluid to be pumped into the suction eye **29*a* for the impeller 26*a* which serves as the inlet end of the plurality of intermediate pumping stages for the centrifugal pump 10. Inducer 23 receives the fluid to be pumped from the inlet passage 30 formed in and by the multi-purpose suction end casing 31 constructed and operative in accordance with the teachings of the present invention shown in more detail at FIGS. 2, 3, 4 and 5** of the drawings.

MULTI-PURPOSE SUCTION END CASINGS

Figure 5:
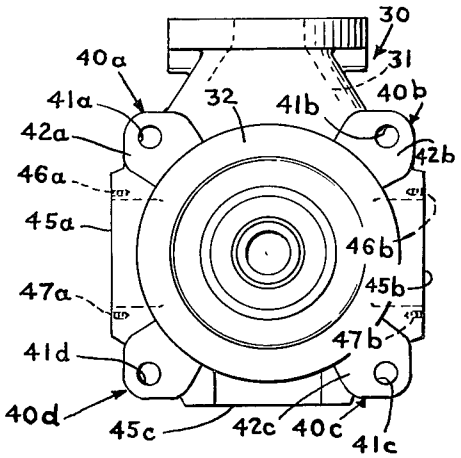
FIG. 5 is an inner end elevational view of the multi-purpose suction end casing shown in FIG. 3.
Figure 4:
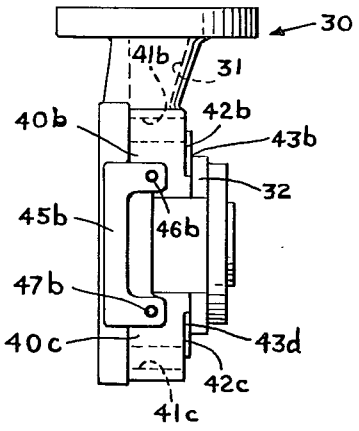
FIG. 4 is a side elevational view of the multi-purpose suction end casing shown in FIG. 3.

Accordingly now referring to FIGS. 1 to 5 of the drawings, the multi-purpose suction end casing 31 is shown as including a generally cylindrical central body portion 32 which has an elongated side projection 33 continuous therewith in which the suction inlet 30 is defined in the manner shown at FIGS. 1 and 5 of the drawings. A connecting flange 34 about the end of the side projection 33 remote from the central body portion 32 provides means for connecting suitable piping, not shown, for delivering the fluid to be pumped to the suction inlet 30 as will be understood by those skilled in the art.

Figure 3:
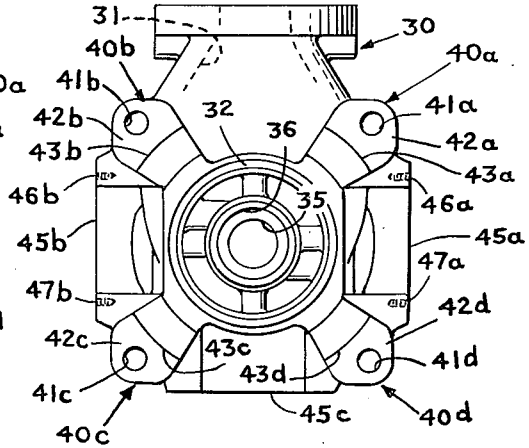
FIG. 3 is an outer end elevational view of the multi-purpose suction end casing shown on the centrifugal pump in FIG. 1.

FIGS. 1, 3 and 5 further show that the suction end casing 31 has an axially disposed bore 35 and coaxial therewith a counter-bore 36 in the central body portion 32. Counter bore 36 formed in the central body portion 32 concentric to the bore 35 has a suitable seal such as the packing assembly 37 mounted therein to prevent leakage of the fluid being pumped. The packing assembly 37 includes the conventional packing follower 38, to maintain the seal as tight as required. Such packing assemblies are well known in the pump art and hence are not more fully described herein.

The bearing housing **22*a* similar to bearing housing 21*a* is connected to the outer face of the central body portion 61 and acts to support the bearing 22 outboard of the packing assembly 69. The bearing housing 22***a*, also had the splash plates 22*d* (not shown), and forms a collecting chamber 22*e* with a drain pipe 22*f* for draining collected leakage.

Figure 2:
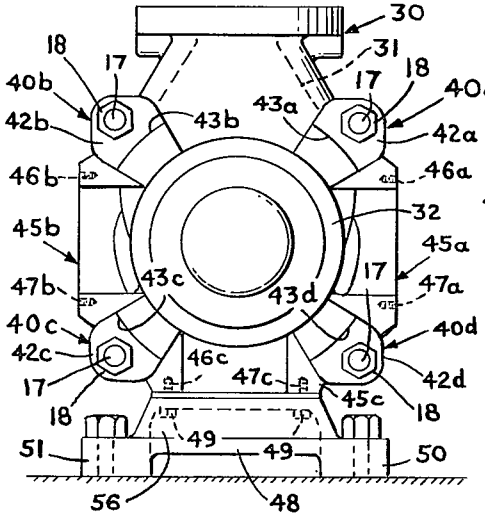
FIG. 2 is a right end view of the multi-stage ring type centrifugal pump shown in FIG. 1 showing one of the detachably connected feet means.

Suction end casing 31 has four tie-rod lugs 40*a*, 40*b*, 40*c*, and 40*d* extending radially from the central body portion 32 at approximately 90° intervals, as is shown in FIGS. 2, 3 and 5 of the drawings. Each of the tie-rod lugs include, a tie-rod bore or opening as at 41*a*, 41*b*, 41*c* and 41*d* through which the respective tie-rods 17 extend for assembling the pump as is made clear from FIG. 1 of the drawings.

Figure 11:
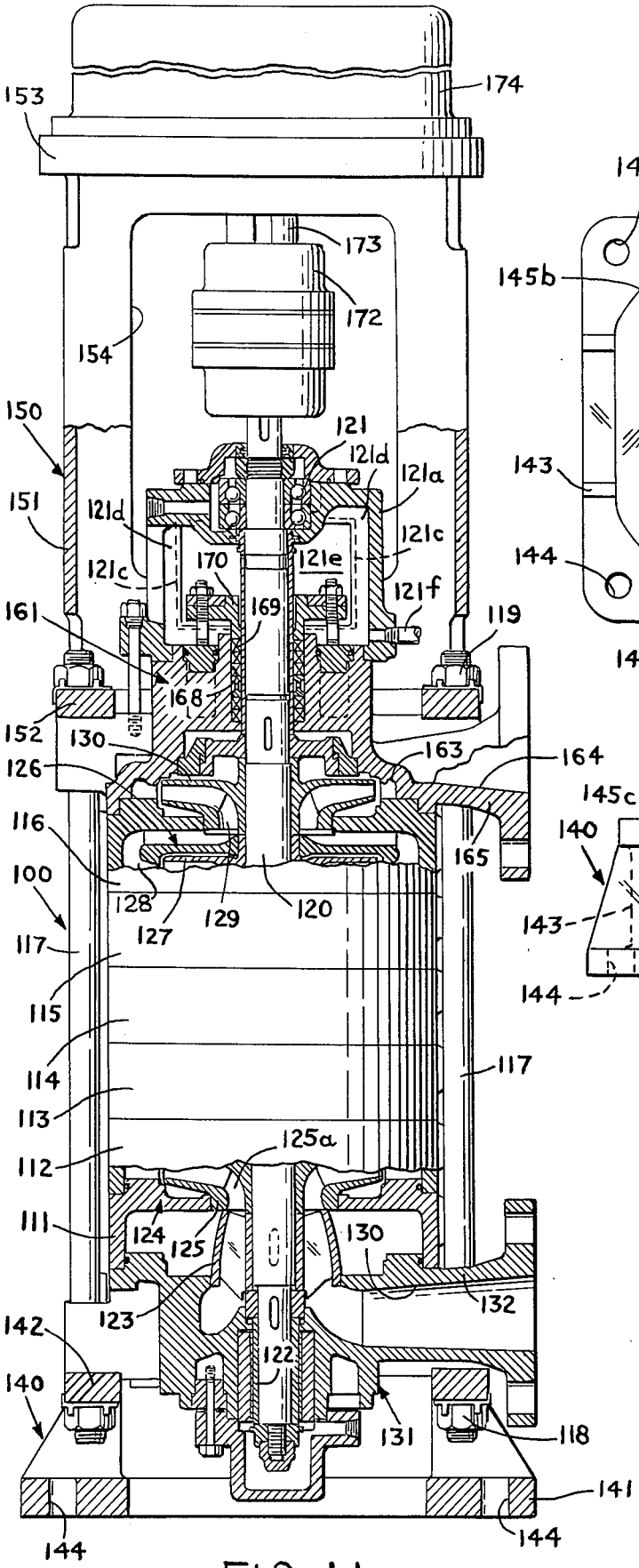
FIG. 11 is a side elevational view with parts in cross-section of a multi-stage ring type centrifugal pump having multi-purpose end casings in accordance with the invention and showing adapter members connected to the respective multi-purpose end casings to permit the centrifugal pump to be vertically disposed.

The outer surfaces of the tie-rod lugs 40*a*, 40*b*, 40*c* and 40*d* has an enlarged machined surface as at 42*a*, 42*b*, 42*c* and 42*d* which defines or forms a rabbet joint or shoulder adjacent each of said enlarged machined surfaces respectively at 43*a*, 43*b*, 43*c* and 43*d* to enable the precise attachement of a variety of adapters as may be required so as to provide for example a vertical side suction dry pit multi-stage ring type centrifugal pump such as the one shown at FIG. 11 of the drawings and more fully described hereinafter.

Multi-purpose suction end casing 31 is also shown in FIGS. 1 to 5 of the drawings as provided with foot mounting members as at 45*a*, 45*b*, and 45*c* which are continuous with but extend radially from the central body portion 32, and like the tie-rod lugs are spaced circumferentially from each other at approximately 90° intervals. However, as is shown in FIGS. 1 to 5 the foot mounting members, are between the tie-rod lugs but only at three positions. These positions will permit the orientation of the side projection 33 relative the remaining elements of the pump casing to any of these three positions.

Each of the foot mounting members 45*a*, 45*b* and 45*c* are provided with tapped bores as at 46*a* and 47*a* on foot mounting member 45*a*; at 46*b* and 47*b* on foot mounting member 45*b* and at 46*c* and 47*c* on foot mounting member 45*c*. The tapped bores 46*a*, 47*a*, 46*b*, 47*b*, and 46*c* and 47*c* on the foot mounting members 45*a*, 45*b* and 45*c* permit a pump casing foot as at 48 to be detachably connected to one of said foot mounting members as is shown for foot mounting member 45*c* in FIG. 2 by suitable threaded members as at 49 which are spaced relative each other so as to engage and fit the associated tapped bores as for example the tapped bores 46*c* and 47*c* on foot mounting member 45*c*.

Depending on the orientation of the side projection 33 one or the other of the respective foot mounting members 45*a*, 45*b* and 45*c* will be positioned to receive the detachably connectable pump casing foot means 48.

Figure 10:
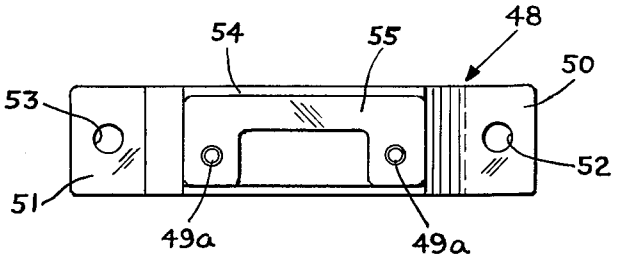
FIG. 10 is a top view of the detachable foot member shown in FIG. 9.
Figure 9:
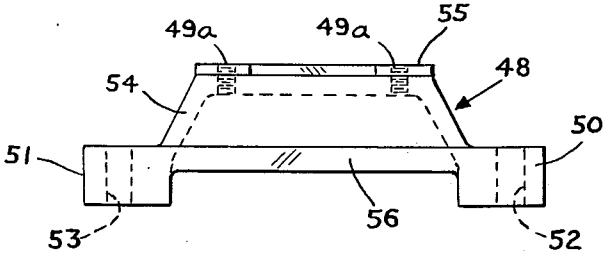
FIG. 9 is a front view of one of the detachable feet members.

FIGS. 9 and 10 show that the pump casing foot means 48 is a substantially elongated member which is provided with a connecting flange at each end as at 50 and 51, and connecting bores as at 52 and 53 for connecting the centrifugal pump 10 to any suitable point of attachment as is illustrated at FIG. 2 of the drawings.

The casing foot means has a raised medial section as at 54 which is provided with a machined surface 55 which is designed to match the foot mounting members 45*a*, 45*b* and 45*c* when in assembled position.

The machined surface is provided with the spaced bores as at 49*a* sized to permit the threaded members 49 to extend therethrough for attachment to the associated foot mounting member when in assembled position.

The raised medial portion 54 is formed as part of a concealing skirt 56 so that the connecting threaded means 49 can be concealed to improve the appearance of the assembled pump.

At the end of the centrifugal pump 10 remote from the multi-purpose suction end casing the last intermediate pumping stage casing 16 which houses the intermediate pumping stage 28*b* is operatively associated so that the impeller 26*b* and the associated discharge diffuser 27*b* will discharge the fluid being pumped into the suction eye 60*a* of the last impeller 60 which in turn is operatively associated with a multi-purpose discharge end casing 61 now to be more fully described.

MULTI-PURPOSE DISCHARGE END CASING

The multi-purpose discharge end casing 61 as shown in FIGS. 1, 6, 7 and 8 of the drawings has substantial similarlity to the general structrual configuration of the multi-purpose suction end casing above described.

Thus the multi-purpose discharge end casing 61 is shown to include a central body portion 62 which in assembled position forms a portion as at 63 of a discharge volute 64 which is operatively associated with the last impeller 60. A discharge outlet 64 is formed in a side projection 65 extending from the central body portion 62. The side projection 65 will have a connecting flange 66 to connect the discharge outlet 64 with suitable piping, not shown, so as to deliver the pumped fluid from the discharge outlet to the point of use or other disposal thereof.

Similar to the suction end casing 31 FIGS. 1, 6, 7 and 8 show that the discharge end casing 61 will have an axially disposed shaft opening as at 67 and a counterbore 68 concentric thereto in the central body portion 62 in which packing assembly 69 is mounted for sealing the other end of shaft 20 to prevent the fluid being pumped from leaking out of the pump 10. The packing assembly 69 is provided with a suitable packing follower 70 to maintain the packing in sealing position in the conventional manner, as will be understood by those skilled in the art.

Connected to the outer face of the central body portion 32 is a bearing housing 21*a* which supports the bearing 21 outboard of the packing 37. About the openings 21*b* in the bearing housing 21*a* is a grooved surface 21*c* in which splash plates 21*d* are removably connected. If leakage occurs the same will collect in the collecting chamber 21*e* found in the bearing housing and a drain pipe 21*f* is provided at the lowermost section of the bearing housing for draining the collected leakage from the collecting chamber 21*e*.

Figure 8:
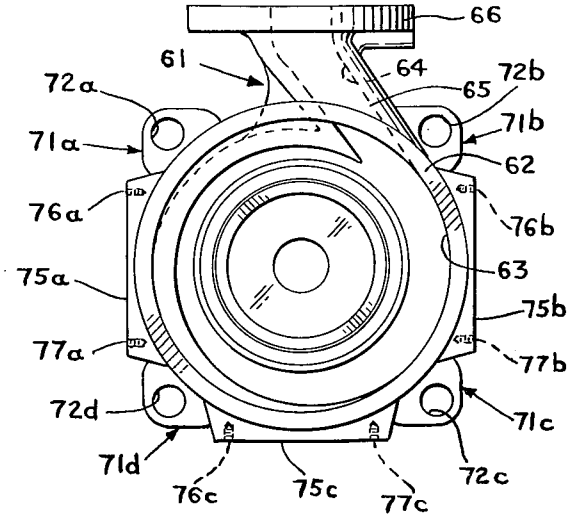
FIG. 8 is an inside end elevational view of the multi-purpose discharge end casing shown in FIG. 6.
Figure 7:
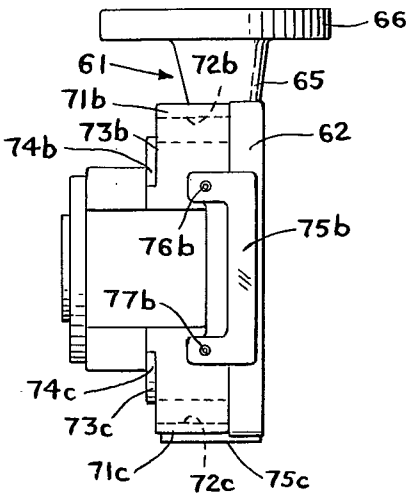
FIG. 7 is a side elevational view of the multi-purpose discharge end casing shown in FIG. 6.
Figure 6:
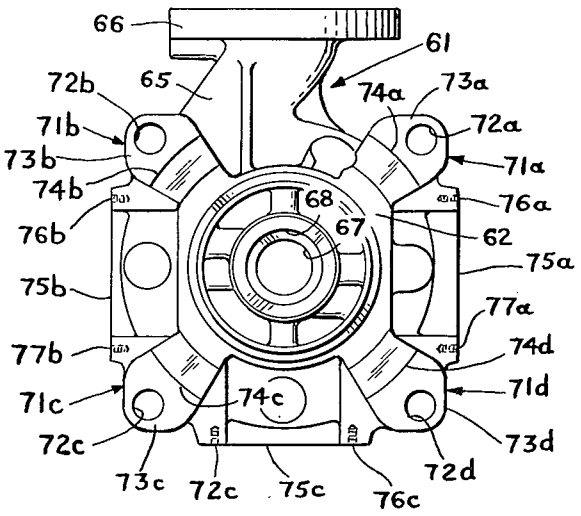
FIG. 6 is an outer end elevational view of the multi-purpose discharge end casing shown on the centrifugal pump in FIG. 1.

Similar to the suction end casing 31, the multi-purpose discharge end casing has four tie-rod lugs 71*a*, 71*b*, 71*c* and 71*d* which extend radially from the central body portion 62 at approximately 90° intervals as is shown in FIGS. 6, 7 and 8. Each of the tie-rod lugs include a tie-rod bore or opening as at 72*a*, 72*b*, 72*c* and 72*d* through which the respective tie-rods 17 extend for assembling the pump 10.

As further made clear from FIGS. 1 and 2 of the drawings and well understood by those skilled in the art, the assembly of the centrifugal pump 10 will require that the tie-rod lugs 40*a*, 40*b*, 40*c* and 40*d* of the multi-purpose suction end casing 31 and the tie-rod lugs 71*a*, 71*b*, 71*c* and 71*d* of the multi-purpose discharge end casing 61 must be brought into alignment so that the tie-rod 17 can be passed through the respective tie-rod openings in these elements in order to assemble the plurality of intermediate pumping stages therebetween.

The outer surfaces of the tie-rod lugs 71*a*, 71*b*, 71*c* and 71*d* respectively have an enlarged machined surface as at 73*a*, 73*b*, 73*c* and 73*d* which defines or forms a rabbet joint or shoulder adjacent each of said machined surfaces respectively at 74*a*, 74*b*, 74*c* and 74*d* to enable the precise attachment of a variety of adapters as may be required so as to provide for example the connection for a motor mount for a vertical side suction dry pit multi-stage ring type centrifugal pump such as the one shown at FIG. 11 of the drawings which will be more fully described below.

Similar to the multi-purpose suction end casing 31, the multi-purpose discharge end casing 61 as shown in FIGS. 1, 6 and 7 of the drawings is also provided with foot mounting members as at 75*a*, 75*b*, and 75*c*. Each of which foot mounting members are respectively provided with tapped bores as at 76*a* and 77*a* on foot mounting member 75*a*; at 76*b* and 77*b* for foot mounting member 75*b* and at 76*c* and 77*c* for foot mounting member 75*c*. These tapped bores 76*a*, 77*a*, 76*b*, 77*b* and 76*c* and 77*c* on the foot mounting members 75*a*, 75*b* and 75*c* also serve to permit a pump casing foot such as the pump casing foot 48 above described to be detachably connected to one of said foot mounting members as is shown for foot mounting member 75*c* in FIG. 1 of the drawings. The detachable casing foot 48 used with the foot mounting members 75*a*, 75*b* and 75*c* will be identical with the pump casing foot 48 above described and will engage and fit the associated tapped bores of foot mounting members 75*a*, 75*b* and 75*c* in the same manner and accordingly this operative association for detachably connecting the pump casing foot 48 to the respective foot mounting members 75*a*, 75*b* and 75*c* will not be further described and this of course applies equally to the manner in which the pump casing feet are oriented and positioned for connection to the respective foot mounting members 75*a*, 75*b* and 75*c*.

It is of course thought obvious that in the case of the horizontal pump, the side projections 33 and 65 can be respectively oriented in different positions so that for example one casing foot 48 can be connected to one foot mounting member such as foot mounting member 45*c* on the multi-purpose suction end casing 31 while another pump casing foot can be connected to foot mounting member 75*b* on the multi-purpose discharge end casing in order to have the suction inlet 30 face in one desired direction and the discharge outlet 64 face in another desired direction and this is believed inherent from the device as above described as will be understood by those skilled in the art.

VERTICALLY ORIENTED SIDE SUCTION MULTI-STAGE RING TYPE CENTRIFUGAL PUMP

Referring now to FIG. 11 a vertical side suction dry pit multi-stage ring type centrifugal pump generally designated 100 is shown having a multi-purpose suction end casing 131 and a multi-purpose discharge end casing 161 each of said casings in accordance with the present invention all as above described.

The centrifugal pump 100 includes a plurality of adjacent and serially connected ring like intermediate pump stage casing members as at 111, 112, 113, 114, 115 and 116 which are connected between the multi-purpose suction end casing 131 and multi-purpose discharge end casing 161 by means of circumferentially spaced tie-rods 117 held in assembled position by tie-rod locking nuts 118 and 119 at the respective opposite ends of each of said tie-rods so that the assembled multi-purpose suction end casing, the plurality of intermediate stage pump casing members, and the multi-purpose discharge end casing 161 provide and form the pump casing for the said vertically disposed side suction dry pit multi-stage ring type centrifugal pump 100.

A pump shaft 120 extends end to end through the centrifugal pump 100 and is journalled for rotation in bearings 121 and 122 as is shown in FIG. 11 of the drawings.

The ring like pumping stage casing members 111, 112, 113, 114, 115 and 116 house a plurality of intermediate centrifugal pumping stages.

In the position normally occupied by the first pumping stage the casing member 111 has a generally convergent inducer 123 which is fixedly connected and rotatably mounted on the pumping shaft 120.

The initial pumping stage 124, a fragment of which is shown, as in the horizontal form of multi-stage ring type centrifugal pump 10 shown in FIG. 1 of the drawings, occupies the space normally occupied by the second pumping stage and the impeller 125 therein which is also fixedly connected to pumping shaft 120 is disposed for operative association with the inducer 123.

The last intermediate pumping stage 126 only a fragment of which is also shown, has its impeller 127 and diffuser 128 disposed to discharge into the suction eye 129 of the last impeller 130 which in turn is associated with the discharge volute 163 formed in the multi-purpose discharge end casing 161 in the same manner above described for the multi-purpose discharge end casing 61 for the horizontal form of multi-stage ring type centrifugal pump shown in FIG. 1 of the drawings.

Since as above described the multi-purpose suction end casing 131 and mutli-purpose discharge end casing 161 for this form of the invention are identical in shape, form and construction to the multi-purpose suction end casing 31 and multi-purpose discharge end casing 61 as above described. It is not thought necessary to repeat the description of these elements to show how they are associated in the vertically oriented form of the multi-stage ring-type centrifugal pump 100 shown in FIG. 11.

Further, the operation as will be understood by those skilled in the art will be the same. Thus, the inducer 123 will receive the fluid to be pumped from the inlet passage 130 in the side extension 132 of the multi-purpose suction end casing 131 and discharges this fluid into the suction eye 125*a* of the impeller 125 which serves as the inlet end of the plurality of intermediate pumping stages for the centrifugal pump 100. Impeller 127 of the last intermediate pumping stage 126 in turn discharges the fluid to be pumped into the last impeller 130 and the fluid is delivered from the last impeller 130 into the discharge volute 163 formed by the multi-purpose discharge end casing and this fluid is passed from the centrifugal pump 100 through the associated discharge outlet 164 in the side projection 165 of the muti-purpose discharge end casing 161 in the same manner as above described for the multi-purpose discharge end casing 61.

The vertical disposition of the vertical side suction dry pit multi-stage centrifugal pump 100 as shown in FIG. 11 is achieved by the use of a pump support adapter 140 which is connected to the multi-purpose suction end casing 131 as hereinafter described and a motor support adapter 150 which is connected to the multi-purpose discharge end casing 161 also as hereinafter described, the respective adapters 140 and 150 being shown in assembled position on the pump as indicated in FIG. 11.

Figure 12:
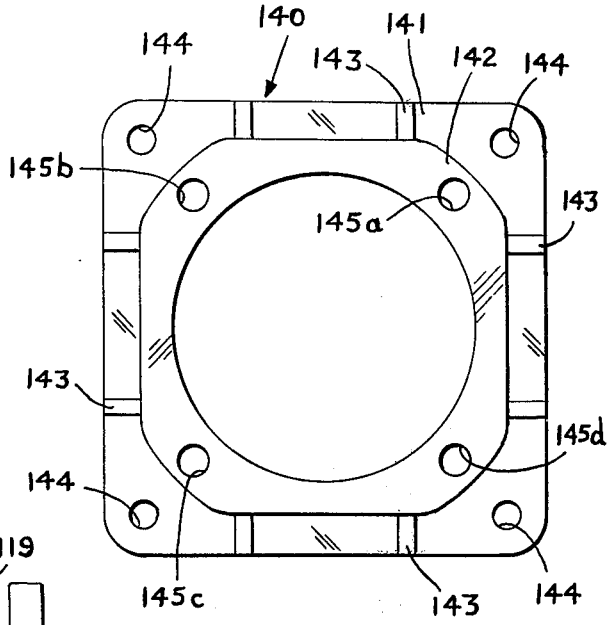
FIG. 12 is a top view of the adapter member connected to the multi-purpose suction end casing of the centrifugal pump shown in FIG. 11.
Figure 13:
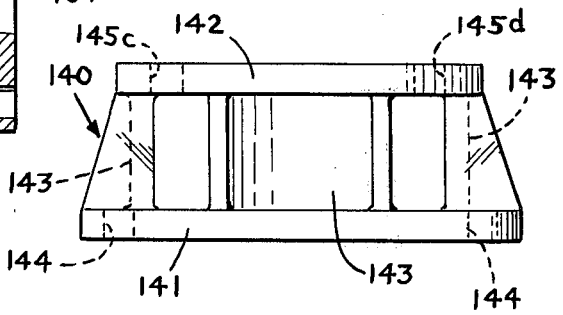
FIG. 13 is a side view of the adapter member shown in FIG. 12.

Thus, by reference to FIGS. 11, 12 and 13 the pump support adapter 140 shown as including a first or lower annular member 141, a second or upper annular member 142 which are held in spaced relation to each other by vertically extended and spaced webs 143.

The first or lower annular member is provided with a plurality of spaced holes or bores 144 therethrough for fixing the pump support adapter 140 and the pump 100 to any suitable point of attachment at the point where the centrifugal pump 100 will be operated.

The second or upper annular member 142 is also provided with a plurality of spaced bores or holes as at 145*a*, 145*b*, 145*c*, and 145*d* which can be aligned with the tie-rod bores in the multi-purpose suction end casing 131 and thus permit the tie-rods 117 to serve as a means for connecting the pump support adapter into assembled position against the enlarged machined surfaces and rabbet or shoulders on the multi-purpose suction end casing in assembled position as is clearly shown in FIG. 11 of the drawings.

The multi-purpose discharge end casing 161 on centrifugal pump 100 is counter-bored as at 168 for a packing assembly 169 to provide a suitable seal about the shaft 120 and the conventional packing follower 170 is provided for maintaining such seal.

As in the pump 10, a bearing housing 121*a* is connected to the outer face of the multi-purpose discharge end casing 161 and supportably carries the ball bearing means 121 therein. As in bearing housings 21*a* and 22*a*, the bearing housing 121*a* will have grooves 121*c* for splash guards or plates 121*d*, and will form a collecting chamber 121*e* a drain pipe 121*f* will be provided to remove collected leakage from the collecting chamber 121*e*.

FIG. 11 further shows that shaft 120 extends through the ball bearing means 121 for connection to coupling means 172 in turn connected to the drive shaft 173 of a conventional electric motor 174 for driving the centrifugal pump 100.

In order to support the motor 174 in proper relation to the centrifugal pump 100 the motor support adapter 150 is provided.

The motor support adapter 150 includes a generally elongated cylindrical body section 151 which has a first annular or lower connecting flange 152 at one end and a second or upper connecting flange 153 at the end remote from the connecting flange 152.

The elongated cylindrical center section 151 is provided with access openings as at 154 to permit the repair and replacement of the coupling 172, ball bearing mean 121, and packing 169.

The lower or first connecting flange 152 is provided with spaced bores thereon to permit the motor support adapter 150 to be aligned with the tie-rod bores in the multi-purpose discharge end casing so that the tie-rods 117 can act to hold the motor support adapter 150 in assembled position for supporting the motor 174 all as shown in FIG. 11 of the drawings.

The upper flange 153 will be provided with suitable connecting means to connect the motor support adapter to the motor 174 as will be understood by those skilled in the art.

Thus there has been shown and disclosed multi-purpose suction end casings and multi-purpose discharge end casings in accordance with the stated objects and purposes of the present invention which are readily and interchangeably utilizable at will in both vertically and horizontally disposed multi-stage ring type centrifugal pumps without requiring any modification of the respective end casings for this purpose.

As was made clear from the above description multi-purpose suction end casings and multi-purpose discharge end casings in accordance with the present invention can be selectively oriented in respect of the desired position for the inlet passage and discharge passage for the fluid being pumped in that they can be positioned in a plurality of directions to facilitate the installation of the respective centrifugal pump on which they are utilized.

More specifically and since four tie-rod lugs are provided symmetrically disposed on each of the respective multi-purpose suction end casings and multi-purpose discharge end casings, it will be clear to those skilled in the art that the inlet passage and discharge passage for any given centrifugal pump on which these devices are utilized can be selectively and independently oriented in any one of four directions at generally 90° intervals.

In the horizontally oriented position as shown in FIG. 1, since the machined foot mounting elements are provided on three sides of each of the respective multi-purpose suction end casing and multi-purpose discharge end casing, they can cooperate as a function of the selective and independent orientation of such inlet passage and discharge passage in any one of three directions, namely, straight up, to the left or to the right as may be required.

Additionally where the given centrifugal pump is vertically oriented as shown in FIG. 11, the respective adapters 140 and 150 can be easily positioned by reason of the enlarged machined surfaces about the tie-rod bores and the rabbet or shoulders formed adjacent thereto to permit precise fitting and adjusting of such adapters for such vertically disposed centrifugal pumps.

While the foregoing description illustrates various preferred embodiments of apparatus and systems in accordance with the present invention, it will be appreciated that certain changes and modifications may be made in the structure of these disclosed arrangements without departing from the spirit and scope of the invention and that the same is defined by the claims as hereinafter set forth.

What is claimed is:

1. In a multi-stage ring type centrifugal pump, a. multi-purpose suction end casing means forming, a suction inlet for the fluid to be pumped by the centrifugal pump, b. a plurality of intermediate pump stage casings having a corresponding plurality of pumping stages formed therein to form a fluid pumping flow path, at least the inlet one of said pumping stages defining an inlet for said fluid pumping flow path in communication with the suction inlet formed by the multi-purpose suction end casing means, c. the last of said plurality of pumping stages defining an outlet for said fluid pumping flow path, d. multi-purpose discharge end casing means forming a discharge outlet for the centrifugal pump and disposed to communicate with the outlet for said fluid pumping flow path formed by the last of said plurality of pumping stages, e. said suction end casing having a first plurality of angularly spaced tie-rod lugs, f. said discharge end casing having a second plurality of angularly spaced tie-rod lugs, g. said first plurality of angularly spaced tie-rod lugs and said second plurality of angularly spaced tie-rod lugs each having a tie-rod bore forming a connecting means extending therethrough and respectively alignable with each other to permit the suction end casing and discharge end casing to be oriented so as to position the suction inlet and discharge outlet in the desired angular position relative to each other, h. tie-rod means extending into the connecting means of said first plurality of tie-rod lugs and said second plurality of tie-rod lugs for holding said suction end casing, said plurality of intermediate pump stage casings, and said discharge end casing of said centrifugal pump in assembled position, and i. means on the respective suction end casing and discharge end casing to aid and facilitate horizontal and vertical orientation of said multi-stage ring type centrifugal pump as desired, wherein said last mentioned means includes, 1. enlarged machined bearing surfaces about said connecting means on the respective plurality of tie-rod lugs and said second plurality of tie-rod lugs,
2. rabbet means formed by and disposed adjacent to each of said enlarged machined bearing surfaces operative with said machined bearing surfaces to provide spaced points of attachment on the respective suction end casing and discharge end casing for vertical orientation of said centrifugal pump,
3. said suction end casing having a first plurality of angularly spaced foot mounting means,
4. said discharge end casing having a second plurality of angularly spaced foot mounting means, and
5. said plurality of angularly spaced foot mounting means and second plurality of angularly spaced foot mounting means alignable in assembled position for horizontal disposition of said centrifugal pump.

2. In a multi-stage ring type centrifugal pump as claimed in claim 1 including, a. first detachable foot means connectable alternatively and selectable to one of said first plurality of angularly spaced foot mounting means on the suction end casing, b. second detachable foot means connectable alternatively and selectively to one of said second plurality of angularly spaced foot mounting means, and c. said first detachable foot means and said second detachable foot means disposed in alignment for horizontal orientation of said centrifugal pump.

3. In a multi-stage ring type centrifugal pump as claimed in claim 1, including, 1. a pump support adapter,
2. means for connecting said support adapter to one of said points of attachment during vertical orientation of said centrifugal pump,
3. a motor,
4. a motor support adapter,
5. means for connecting said motor support adapter between one of said points of attachment and said motor during vertical orientation of said centrifugal pump.

4. A multi-purpose suction end casing for multi-stage ring type centrifugal pumps comprising, a. a central body portion defining a suction inlet chamber, b. a side projection connected to said central body portion having a connecting flange on the remote end thereof, c. said side projection having an inlet passage extending therethrough disposed to communicate with said suction inlet chamber for delivering fluid to be pumped thereto, d. spaced tie-rod lugs extending at angular intervals with respect to each other from said central body portion, and having tie-rod bores therethrough, e. machined bearing surface means on each of said tie-rod lugs defining rabbet means adjacent each of said machined bearing surface means, and f. angularly spaced foot mounting elements connected about said central body portion for operative association with said spaced tie-rod lugs.

5. A multi-purpose suction end casing for multi-stage ring type centrifugal pumps as claimed in claim 4 including, a. said tie-rod lugs disposed at spaced angular intervals at approximately 90°, and b. the foot mounting elements disposed at spaced angular intervals from each other at approximately 90° but offset from said tie-rod lugs and on the side of said central body portion away from said side projection.

6. A multi-purpose discharge end casing for multi-stage ring type centrifugal pumps comprising, a. a central body portion defining at least a section of a discharge volute, b. a side projection connected to said central body portion having a connecting flange on the remote end thereof, c. said side projection having a discharge outlet extending therethrough disposed to communicate with said section of the discharge volute for passing fluid from said centrifugal pump, d. spaced tie-rod lugs extending at angular intervals with respect to each other from said central body portion, and having tie-rod bores therethrough e. machined bearing surface means on each of said tie-rod lugs defining rabbet means adjacent each of said machined bearing surface means, and f. angularly spaced foot mounting elements connected about said central body portion.

7. In a multi-purpose end casing as claimed in claim 6 wherein, a. said tie-rod lugs are disposed at spaced angular intervals of approximately 90°, and b. the foot mounting elements are also disposed at spaced angular intervals from each other of approximately 90° but offset from said tie-rod lugs and on the side of said central body portion away from said side projection.

8. A multi-purpose discharge end casing for multi-stage ring type centrifugal pumps comprising, a. a central body portion defining at least a section of a discharge volute, b. a side projection connected to said central body portion having a connecting flange on the remote end thereof, c. said side projection having a discharge outlet extending therethrough disposed to communicate with said section of the discharge volute for passing fluid from said centrifugal pump, d. spaced tie-rod lugs extending at angular intervals with respect to each other from said central body portion, and having tie-rod bores therethrough, e. machined bearing surface means on each of said tie-rod lugs defining rabbet means adjacent each of said machined bearing surface means, f. a bearing housing operatively connected about the outboard end casing, g. removable shield means on said housing defining a collecting chamber in said bearing housing, and, h. an outlet pipe connected to said bearing housing and in communication with the collecting chamber to permit collected fluid in said collecting chamber to pass therefrom, and i. angularly spaced foot mounting elements connected about said central body portion.

9. In a multi-purpose discharge end casing as claimed in claim 8 wherein, a. said tie-rod lugs are disposed at spaced angular intervals of approximately 90°, and b. the foot mounting elements are also disposed at spaced angular intervals from each other of approximately 90° but offset from said tie-rod lugs and on the side of said central body portion away from said side projection.

* * * * *